US010288370B2

(12) United States Patent
Harvey

(10) Patent No.: US 10,288,370 B2
(45) Date of Patent: May 14, 2019

(54) METHODS AND DEVICES FOR SUPERVISION OF FIREARM CHAMBER LOADING

(71) Applicant: Thomas Danaher Harvey, Rockville, MD (US)

(72) Inventor: Thomas Danaher Harvey, Rockville, MD (US)

( * ) Notice: Subject to any disclaimer, the term of this patent is extended or adjusted under 35 U.S.C. 154(b) by 49 days.

(21) Appl. No.: 15/661,007

(22) Filed: Jul. 27, 2017

(65) Prior Publication Data

US 2017/0336163 A1 Nov. 23, 2017

Related U.S. Application Data

(63) Continuation of application No. 14/866,965, filed on Sep. 27, 2015, now abandoned.

(51) Int. Cl.
*F41A 17/06* (2006.01)
*F42B 8/08* (2006.01)

(52) U.S. Cl.
CPC ..... *F41A 17/063* (2013.01); *F42B 8/08* (2013.01)

(58) Field of Classification Search
CPC ..... F41A 17/06; F41A 17/08; F41A 17/20; F41A 17/44; F41A 17/46; F41A 9/52; F41A 9/53; F42B 8/08
See application file for complete search history.

(56) References Cited

U.S. PATENT DOCUMENTS

2014/0272808 A1* 9/2014 Guissin ..... F41A 33/00 434/20

* cited by examiner

*Primary Examiner* — Timothy A Musselman

(57) ABSTRACT

A method of supervising the safe carrying of firearms establishing rules for the situations where live ammunition is allowed to be in the chamber of the firearm. A supervisor checks that a dummy round is in the chamber of the firearm before the supervised person goes on duty outside of direct supervision. The dummy round is designed so that it records occasions when it is removed from the chamber. The recording is designed to last until checked by the supervisor. In some cases the dummy round undergoes changes that make the recording. In other cases the dummy round keeps count of the number of times it is removed from the chamber. In still other cases the dummy round communicates with a device which makes the recording. In each of these cases the system of supervision insures that live ammunition is only chambered when appropriate.

20 Claims, 6 Drawing Sheets

METHODS AND DEVICES FOR SUPERVISION OF FIREARM CHAMBER LOADING

CROSS REFERENCE TO RELATED APPLICATIONS

This application is a continuation of U.S. patent application Ser. No. 14/866,965 filed Sep. 27, 2015 which is now pending.

STATEMENT REGARDING FEDERALLY SPONSORED RESEARCH OR DEVELOPMENT

Not Applicable

BACKGROUND OF THE INVENTION

Field of the Present Invention

The present invention is in the field of firearm safety.

Background Concerning the Need for the Current Invention

Security personnel and law enforcement officers who carry firearms face a delicate balance between readiness and safety. One of the most important decisions in establishing this balance is the decision of whether to have a round of ammunition in the chamber of the weapon making it ready to fire immediately in a crisis or to require that the slide of the weapon be operated to load a round before it's ready to fire.

The time and action required to put a round into the chamber is sufficient to greatly reduce the probability that there will be an accidental shooting or a shooting that in the light of hindsight should not have occurred. Agencies and companies who employ these personnel have a strong interest in safety in this matter. Accidental or ill-considered shootings have resulted in many multi-million dollar settlements with victims or their families. They often have empty chamber policies that require that their personnel not carry weapons with a round in the chamber, but enforcement of these policies is difficult.

The armed personnel who face a potential need for instant decisions in crisis situations can be influenced by outside factors to make a decision that runs against the organizational policy. They are taught to focus on the dangers of their jobs, a focus that is needed to provide the necessary vigilance. They practice using their weapons over and over again. While most will follow the organizational policies, some will allow themselves to make other decisions unless adequate supervision is provided. Thus, there is a need for effective enforcement of policies that specify the situations in which carrying a weapon with a round in the chamber are allowed.

As an illustration of this problem, consider the well publicized incidents where an office has unintentionally drawn a firearm and shot someone when the intention was to draw a Taser to only to subdue that person. Officers shoot hundreds or thousands of rounds of firearm ammunition in their training and a practice round cost the agency less than one dollar. The officer may have only actually shot one or two Taser rounds in practice, if any, and a practice round for a Taser costs about thirty dollars. It shouldn't be surprising that there is a substantial risk of drawing the wrong weapon. But a Taser doesn't require working a slide and such a requirement would be an effective reminder to catch such a mistake before damage is done.

A firearm that is ready to fire instantly on operation of the trigger is also a danger to the person carrying it. There an additional benefit of not having a round chambered when carrying a firearm in the reduction in the probability that an adversary who grabs the weapon will use it to harm anyone. The adversary may not know of the necessity to work the slide. The dummy round can be made so that the impact of the firing pin detaches the rim at the rear of the round and disables the operation of the extractor.

Patents and Applications to be Distinguished from the Current Disclosure

Various current systems have a dummy ammunition round or at least a round which does not produce a projectile leaving the firearm. See for example US Patent Application Publication 2004/0211103 (Safety Cartridge) and U.S. Pat. No. 6,698,126 to Worley (Safety Bullet).

Other firearm safety systems including the above that function by having the dummy round perform its function when struck by the firing pin and are disabled by the cycling function of the weapon. The current disclosure works by a completely different principle which is actuated by the cycling function of the weapon. In addition the subsequent structures and functional steps of the current disclosure are completely missing in the systems above.

BRIEF SUMMARY OF THE INVENTION

A method of supervision the status of chamber loading of weapons carried by personnel. A supervising authority establishes rules which define situations where live ammunition is allow to be kept in the chamber of a weapon and other situations where chambered live ammunition is not allowed. The rules may specify actions to be take before after or during chambering ammunition.

A dummy round of ammunition is used to enforce the rules. The dummy round is enabled to record its removal after being placed in the chamber. The recording persists if the dummy round is removed and later replaced in the chamber. The presence of the dummy round prevents discharge of the weapon. The placement of the round is made under automated or human supervision. The recording is consulted to determine compliance with the rules.

The dummy round can have an indicator on the round to indicate its removal, but it can also work by transmitting a signal to a remote recorder. The indicator may display the fact of removal or more detailed information such as time of removal or a count of removal events.

The invention also includes the dummy round as a device or component of a system. It is sized to fit in the chamber of the firearms to be supervised and contains the means of detecting removal and recording in a persistent manner at least one removal event. The round may be designed to be removed by the weapons normal method of working the slide and typically chambering a replacement live round.

In other situations the usage may be monitored without controlling usage in a supervision system. The dummy round records its removal and blocks operation of the firearm when in place. The recording is read to determine the history of firearm usage. The ere may be a recording means that records multiple events, an indicator to show removal, a means of transmitting removal information to an outside recording or a simple count of the number of removal events.

BRIEF DESCRIPTION OF THE SEVERAL VIEWS OF THE DRAWING

The features and advantages of the various embodiments disclosed herein will be better understood with respect to the drawing in which.

DETAILED DESCRIPTION OF THE INVENTION AND EMBODIMENTS

Definitions

The definitions given in this section are intended to apply throughout the specification and in the claims.

A dummy round of ammunition is an object dimensioned to fit into the chamber of a firearm or other chambered weapon which is not designed propel a projectile from the weapon. It includes inert rounds which have no explosive action when initiated and blank rounds which produce an explosive retort but do not have projectiles.

Ammunition which is capable of propelling a projectile is called live ammunition or live rounds.

Placing live ammunition in the chamber of a firearm may be called chambering a live round.

A period of time during which a supervised person carries a firearm and cannot be directly observed is called a carry period or a duty shift.

Description of Some Functions.

The rules established for use of firearm or other weapon describe the situations where live ammunition is allowed to be placed in the chamber of the weapon. The rules may prohibit chambering live ammunition under described conditions or they may proscribe procedures conditioned upon chambering live ammunition. The procedures may be required before, during or after chambering the ammunition.

Supervision of usage of a firearm may be by inspection or observation by a person other than the supervised person, or it may be by means of equipment or systems that record the events being checked by the supervision. Supervision can also work by controlling actions. An example, would be an automated system that does not issue a clip of live ammunition until the chambering of the recording dummy round is confirmed.

There are numerous means of detecting the removal of a chambered round from a firearm. Some of these detect the proximity of the chamber by electronic sensors. Another way is to mechanically detect the presence of a chamber wall next to the dummy round. A third way is to detect the action of an extractor, a bolt, or a chamber closing block comprised in the weapon.

There are numerous means of recording the detection of removal once it has occurred. The dummy round can be changed in a way that does not reverse when it is reinserted in the chamber. A spring device such as in FIG. 2. may be used. In other cases there may electronic recording in the dummy round as in FIG. 8, and in still other cases the round may communicate with a separate recording device as in FIG. 7.

Figure 7:
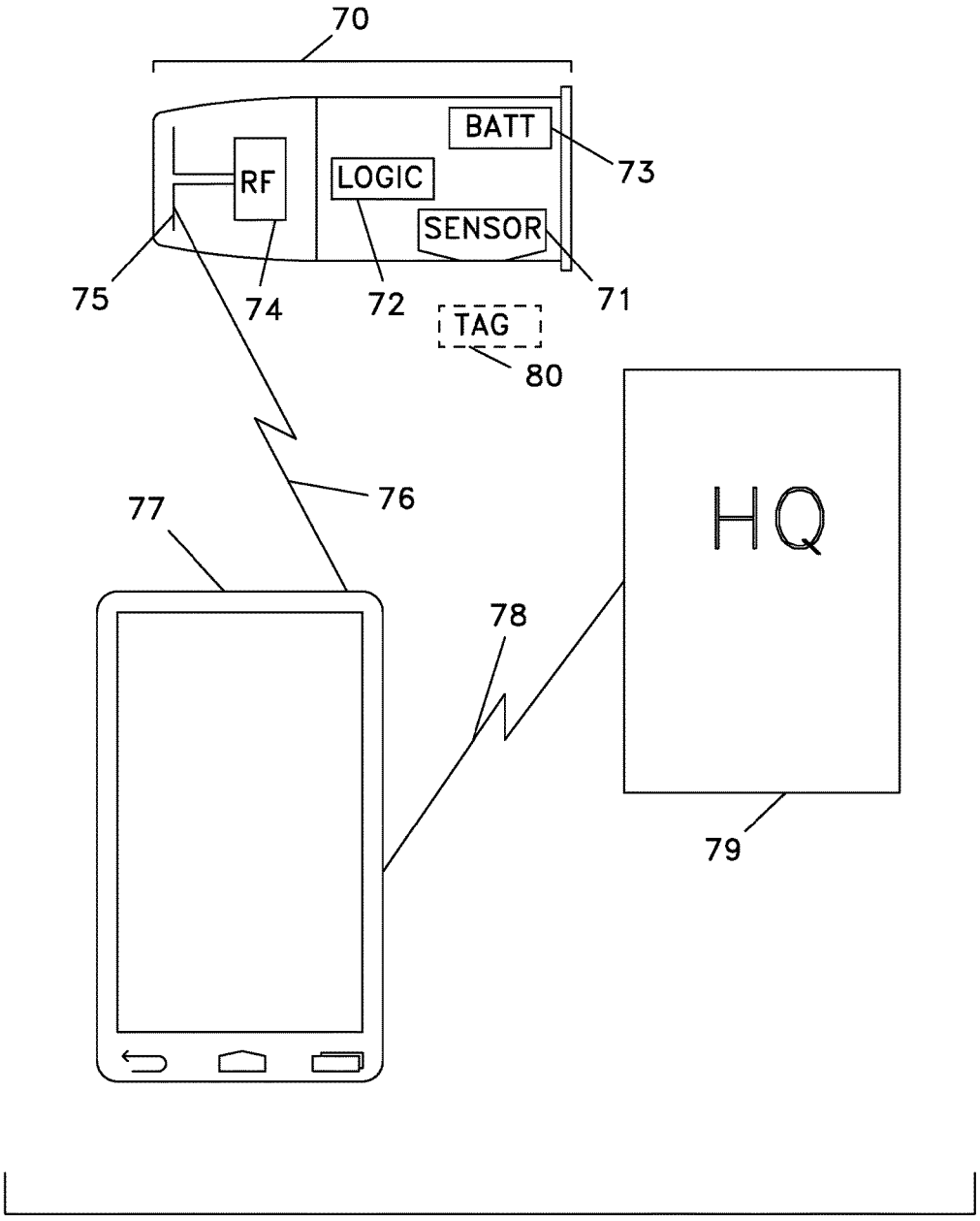
FIG. 7 shows a dummy round designed to report over wireless links to the headquarters of a supervising organization.

Communication between the dummy round a system or device to record the extraction event is shown in FIG. 7 with particular technologies carry information to the recorder. Many technologies exist that would be able to handle this task, some of them by radio but others by infrared, sound, mechanical or electrical connection or other transmission mediums. Current technologies include Bluetooth, Wi-Fi, cell phone carrier systems, infrared links, sonic pulse, and proprietary radio protocols. Other or new technologies are likely to appear and they would be equivalent to the technologies listed for the purposes described herein, but may be chosen as a design choice in a particular implementation to take advantage of expected advances in communication technology.

Figure 1:
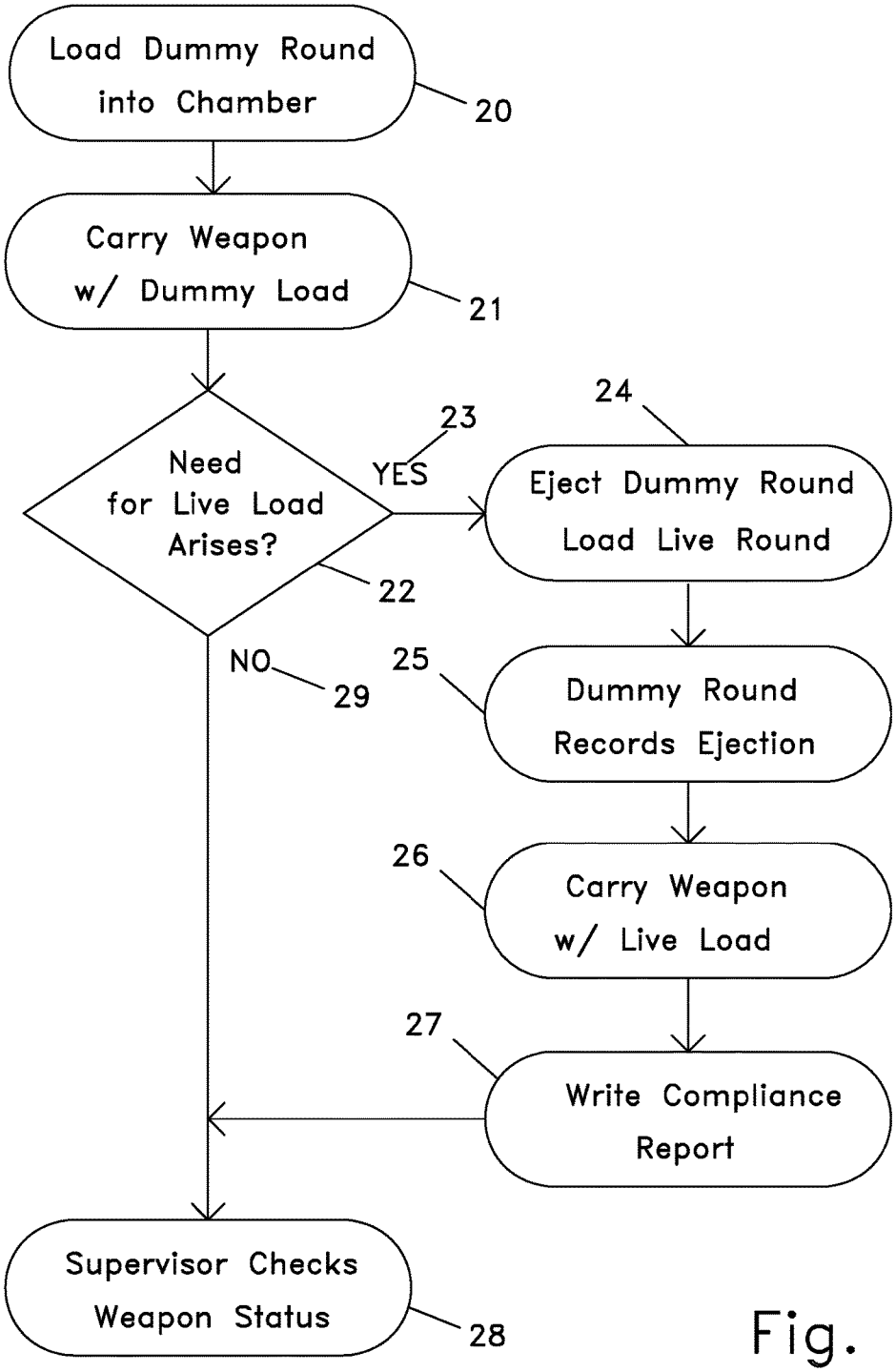
FIG. 1 is a diagram of the basic steps in a simple embodiment of the disclosed method.

Referring to FIG. 1 the operation of a method of supervising the carrying of a firearm is diagrammed. A recording dummy round is loaded into the chamber of the duty weapon for an armed supervised person in the first step 20. The loading is supervised and checked to insure that any required confirmations of dummy round identification, presence or configuration are correct. The supervised person then leaves the area where direct supervision is available and carries out duties 21 with a dummy round in the chamber of the weapon. The duties may or may not cause the supervised person to load the chamber of the weapon with live ammunition. This decision 22 may be made due to changing circumstances and be made in advance of entry into a dangerous situation or may be made immediately before use of the weapon. If a decision 23 to load live ammunition is made then the state of carrying a weapon with live ammunition in the chamber 26 is entered. The rules established by the supervision system would then require compliance action such as writing a report of the incident 27 and at the end of the duty period the supervised person would be checked 29 by a supervisor who would know to check the compliance action. If no need to load live ammunition occurred on the particular time diagrammed 28 then the supervisor would still check to confirm that no loading had in fact occurred.

Figure 2:
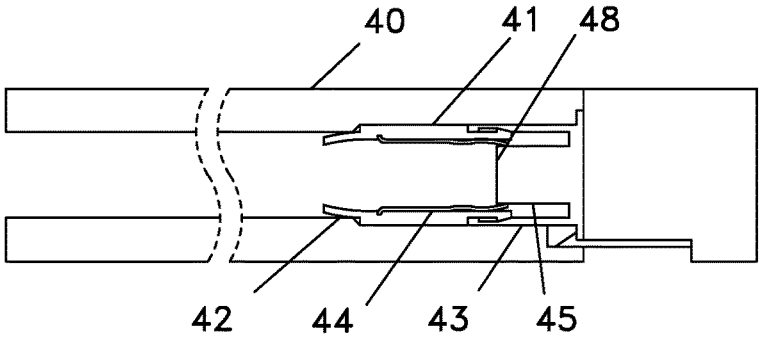
FIG. 2 shows portion of a firearm with a dummy round in the closed chamber.

Referring to FIG. 2, the barrel 40 and chamber 41 of a firearm is shown. A simple and preferred embodiment of a dummy round designed to record extraction of the chamber is shown with a fixed portion 42 in the front of the chamber. The chamber is closed on the round and a movable portion 43 is filling the remainder of the chamber. A boss 45 on the movable portion holds in the opened position an indicator element 44. The fixed 42, movable 43 and indicator 44 elements together form the dummy round. The front face of the boss 48 is colored with a distinctive color and is visible down the length of the barrel.

Figure 3:
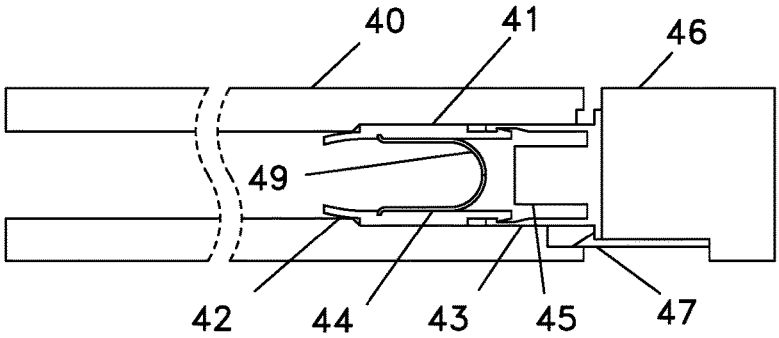
FIG. 3 shows portion of a firearm with a dummy round partially extracted in an opening chamber.

Referring to FIG. 3, the barrel 40 and chamber 41 and the fixed portion of the dummy round 42 are as in FIG. 2. A bolt 46 of the firearm is shown and in this figure it has been moved rearward beginning to open the chamber. An extractor 47 attached to the bolt is moving the movable portion 43 of the dummy round rearward and the boss 48 is removed from contact with the indicator element 45. The indicator element springs inward as explained below and exposes its interior surface surfaces 49 to the front of the barrel. These surfaces are finished with a distinctive color chosen to be distinguished from the color of the face of the boss and allowing visual inspection down the length of the barrel to determine the condition of the indicator element. The rearward movement of the bolt may continue and completely extract the dummy round to allow replacement by a live round.

Figure 4:
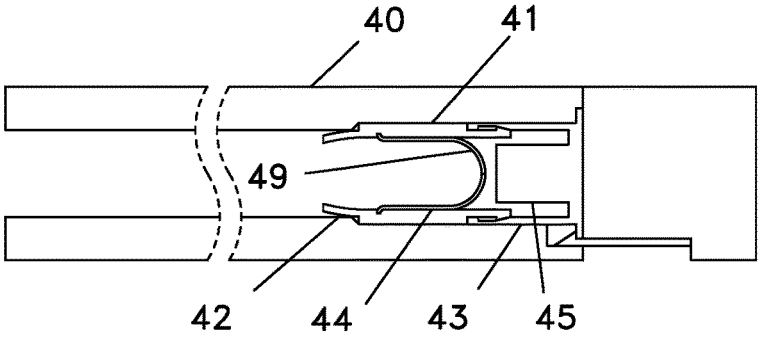
FIG. 4 shows portion of a firearm with a dummy round reinserted into a closed chamber with an indicator element displaying prior extraction.

Referring to FIG. 4, the dummy round has been replaced in the chamber and the bolt reclosed in an attempt to restore the weapon the condition prior to extraction of the dummy round. The configuration of the indicator element 44 is such that it remains closed with the surface 49 exposed through the bore and it is possible by inspection down the length of the barrel to determine that the dummy round has previously been extracted.

Figure 5:
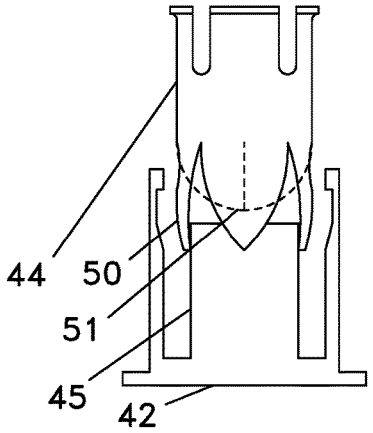
FIG. 5 shows details of the indicator component of a dummy round.

Referring to FIG. 5, details of the movable portion 43 and indicator 44 of a dummy round are shown in a side view. The 4 leaves 50 of the indicator are held open under tension by the boss 45 of the movable portion of the dummy round. When the movable portion is retracted during ejection as shown in FIG. 3 then the 4 leaves spring inward 51 to close the indicator. The indicator is made by forming in the closed position and forced open in the factory assembly of the dummy round.

Figure 6:
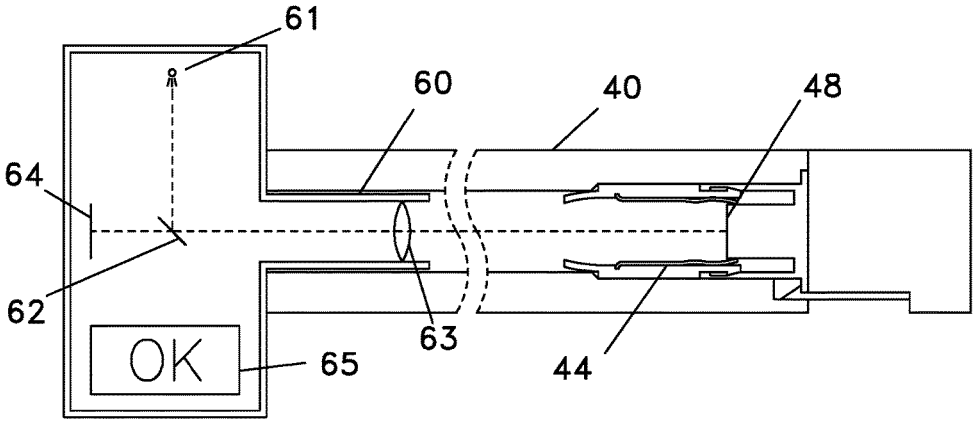
FIG. 6 shows a device for a supervisor to inspect the condition of an extraction recording dummy round while in the chamber of a firearm.

The extraction recording dummy round of FIG. 2-5 can be inspected by a supervisor using a device to show the condition of the indicator. Referring to FIG. 6 a firearm with a barrel 40 and a dummy round with an indicator part 44 and a movable part with a display surface 48 is shown. An inspection device comprising items 60-61 is shown. A barrel adapter 60 guides the device into the barrel of the firearm. Light emitted by a light source 61 is reflected by a partial mirror 62 down the barrel and strikes the display surface 48 of the moveable portion of the dummy round and is reflected back up the barrel. The illumination and the reflected beam are focused by a lens or other optics 63 in their path. On striking a sensor 64 the reflected light causes the condition of the dummy round to be read on a display. In a simple case the display indicates only a difference between detecting a reflection from the dummy round display surface 48 and detecting the inside surface (49 of FIG. 4) of a closed indicator part of a dummy round. In a more sophisticated version the display surface 48 can be imaged by the sensor 64 and displayed on the display 65. This would allow a supervisor to confirm information such as a serial number printed on surface 48. Appropriate circuitry, controls and a power source are provided to operate the components listed above. Supervisors can check the condition of the dummy round to enforce the rules as the supervised person returns from armed duty or at scheduled or unscheduled times during the armed duty time.

Referring to FIG. 7, an embodiment is shown in which the dummy round provides notice of its removal to the headquarters of a supervising organization. A dummy round 70 is used in accordance with the procedures of FIG. 1. When it is removed or replaced in the chamber of a weapon a sensor 71 detects the change of condition and using logic module 72 powered by power source 73 a signal 76 is caused to be emitted by signal transmitter 74 with antenna 75. In the specific version depicted the signal uses Bluetooth technology to transmit to a personal device 77 carried by the supervised person. An application running on the device 77 transmits via a standard Wi-Fi or phone carrier wireless link 78 to the headquarters 79 of the organization requiring supervision where the time and nature of the change of condition is logged. The figure depicts a two stage wireless reporting system, but many standard wireless technologies exist and one stage direct wireless versions can be implemented by standard methods over standard wireless protocols. In some situations the best implementation may be to log the event using appropriate secure technology directly on the personal device 77 which can be inspected periodically by a supervising organization.

In a slightly more elaborate implementation of the system of FIG. 7 the sensor in the round is enabled to detect that the dummy round is inserted into a specific firearm. The firearm is equipped with a sensor readable id tag 80 which allows the dummy round to confirm via its detection link that the dummy round is inserted into the correct weapon. This allows automation of the initial supervisory step in insuring compliance with the established rules. It also serves in increase the security and certainty of the system by preventing substitution of weapons by supervised personnel. Various well known technologies such as RF-ID or optical reading of engraved marks could be used to implement this elaboration.

Figure 8:
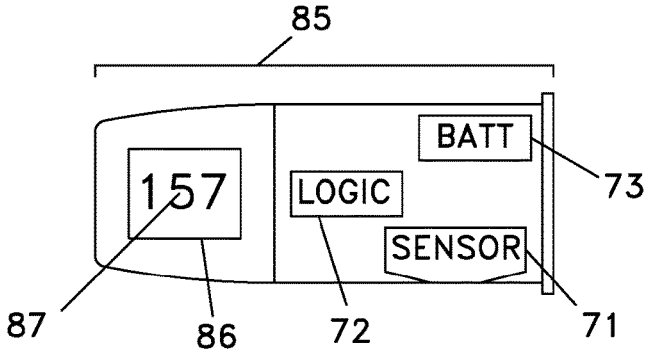
FIG. 8 shows a dummy round designed record the number of removals from a chamber and show that number on a display.

FIG. 8 shows a dummy round 85 designed record the number of removals from a chamber and show that number on a display. A sensor 71, a logic module 72 and a power source 87 are similar to the round of FIG. 7 except that the logic module is designed to operate a numerical display 86 which shows the number of times that the round has been removed from the chamber of a firearm. The number 87, which shows on the display as 157 in the figure, indicates a continuing count which could be compared by a supervisor to the expected number in a log to detect situations where the supervised person carrying the firearm has removed the round potentially in order to chamber a live round. In a related version the display could be placed on the front end surface of the dummy round and read by the imaging version of the device of FIG. 6. This would allow a supervisor to check the number during the carry period (duty shift) of the supervised person without advancing the displayed number or requiring an update to the number expected at the end of the carry period.

Figure 9:
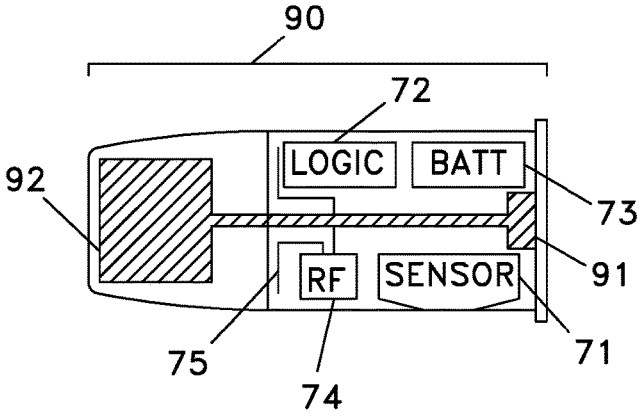
FIG. 9 shows a blank round designed to report over wireless links to the headquarters of a supervising organization.

FIG. 9 shows a blank round 90 designed to report over wireless links to the headquarters of a supervising organization. The radio signal from the round would be handled the same way as in FIG. 7 but this round differ in having a function as blank ammunition to make a warning retort when the primer is struck by the firing pin. The electronic components should be made to withstand the shock of firing the blank charge. Suitable means for that hardening are well known to persons skilled in making projectiles with electronic functions such as exploding rounds with electronic fuses. If the RF connection is not functional after blank use the condition of the round will allow supervision by detection of use. Shown are the components similar to FIG. 7 a sensor 71, a logic module 72, a power source (battery) 73, an rf module 74 and an antenna 75. The additional components needed for blank round functionality are a primer 91 and a blank explosive charge 92. Blank rounds do not normally work to operate the function of an automatic firearm without special provision, so after use of the blank as a warning, the user of the firearm much work the slide to load a live round for further use.

Figure 10:
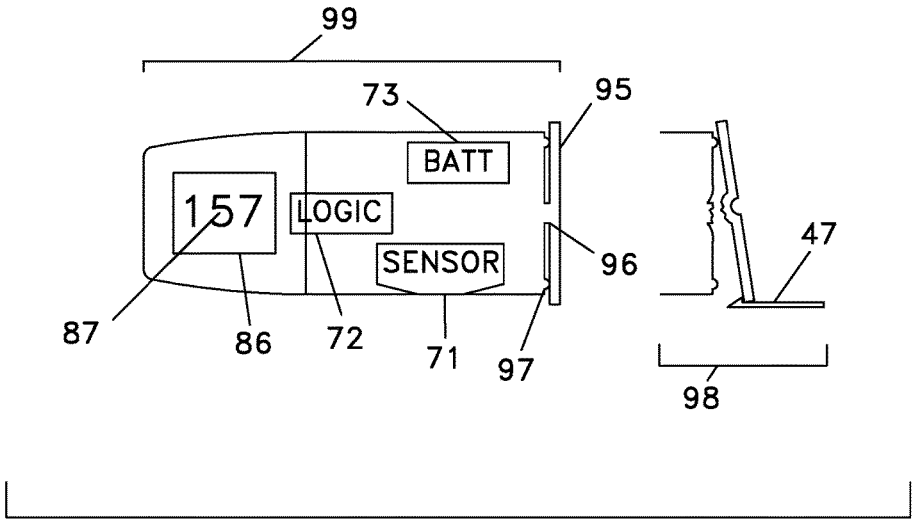
FIG. 10 shows a blank round designed prevent extraction after impact of a firing pin.

FIG. 10 shows a blank round 99 designed prevent extraction after impact of a firing pin. The dummy round of FIG. 8 is modified in this embodiment to add a detachable rim 95 which is attached to the body of the round by a bridge 96 constructed of a brittle material. The rim is supported by bumps 97 on the body of the round but only connected by the bridge. On impact in the center of the rear face of the round by a firing pin the bridge is crushed resulting in a condition shown 98 where the extractor 47 of the firearm is ineffective in removing the round from the chamber of the firearm. This prevents an adversary who grabs the firearm and attempts to discharge it from subsequently using the slide to put a live round into the chamber until the dummy round is removed by other means than the extractor.

I claim:

1. A method of supervision for safe usage of a firearm comprising:

establishing rules for a supervised person carrying a firearm with a chamber wherein the rules define a situation in which the supervised person is permitted to have live ammunition in the chamber and at least one of a situation in which the supervised person is not permitted to have live ammunition in the chamber and an action required of the supervised person when live ammunition is placed in the chamber of the firearm, supervising the insertion of a dummy round of ammunition into the chamber wherein the dummy round has a recorder to record removal of the dummy round from the chamber after the insertion and wherein (a) the recording persists if the dummy round is reinserted into the chamber after the removal and (b) the firearm cannot be discharged without removing the dummy round, allowing the supervised person to carry the firearm while the presence of the dummy round in the chamber cannot be directly observed, and determining compliance with the rules by examining the recording of the dummy round.

2. The method of claim 1 wherein:

the dummy round comprises an indicator designating removal of the round from the chamber.

3. The method of claim 1 wherein:

the dummy round comprises a means to transmit information signifying removal of the round from the chamber to a device which records the removal.

4. The method of claim 1 wherein:

the dummy round comprises a means to count events where the dummy round has been removed from the chamber of the firearm.

5. The method of claim 1 wherein:

the firearm has a slide and operation of the slide removes the dummy round from the chamber to allow insertion of a replacement round.

6. The method of claim 5 wherein:

the dummy round comprises an indicator designating removal of the round from the chamber.

7. The method of claim 5 wherein:

the dummy round has a transmitter to transmit information signifying removal of the round from the chamber to a device which records the removal.

8. The method of claim 5 wherein:

the dummy round has a counter to count events where the dummy round has been removed from the chamber of the firearm.

9. A device for monitoring the condition of a firearm with a chamber and a slide comprising:

a dummy round of ammunition dimensioned to fit in the chamber of the firearm, a sensor to detect the removal of the dummy round from the chamber subsequent to the insertion of the dummy round into the chamber, a recorder to record the detection by the sensor of removal of the round from the chamber wherein the recording persists and can be read after reinsertion of the dummy round into the chamber.

10. The device of claim 9 wherein:

the dummy round is configured to be removed from chamber by the operation of a slide comprised in the firearm.

11. The device of claim 9 wherein:

the sensor and the recorder are comprised in the dummy round.

12. The device of claim 9 wherein:

the dummy round comprises a means of signaling a condition of being in a chamber to a signal receiver away from the firearm.

13. The device of claim 9 wherein:

the firearm has a slide and operation of the slide removes the dummy round from the chamber to allow insertion of a replacement round.

14. The device of claim 13 wherein:

the sensor and the recorder are comprised in the dummy round.

15. The device of claim 13 wherein:

the dummy round comprises a means of signaling a condition of being in a chamber to a signal receiver away from the firearm.

16. A method monitoring the usage of a firearm with a chamber comprising:

inserting a dummy round of ammunition into the chamber wherein the dummy round comprises a recorder to produce a record of removal of the dummy round when the round is removed from the chamber after the insertion and wherein (a) the record persists if the dummy round is reinserted into the chamber after the removal and (b) the firearm cannot be discharged without removing the dummy round and reading the record to determine a history of the potential loading of the firearm with live ammunition.

17. The method of claim 16 wherein:

The recorder is enabled to record the times of multiple events of removal of the dummy round from the chamber of the weapon.

18. The method of claim 16 wherein:

the dummy round comprises an indicator designating removal of the round from the chamber.

19. The method of claim 16 wherein:

the dummy round comprises a means to transmit information signifying removal of the round from the chamber to a device which records the removal.

20. The method of claim 16 wherein:

the dummy round comprises a counter to count events where the dummy round has been removed from the chamber of the firearm.

* * * * *